United States Patent [19]

Botvin

[11] 4,040,139

[45] Aug. 9, 1977

[54] SCOURING PAD OR THE LIKE

[75] Inventor: George B. Botvin, Cumberland, R.I.

[73] Assignee: ACS Industries, Inc., Woonsocket, R.I.

[21] Appl. No.: 590,102

[22] Filed: June 25, 1975

Related U.S. Application Data

[63] Continuation-in-part of Ser. No. 553,509, Feb. 27, 1975.

[51] Int. Cl.[2] ..... A47L 17/08; D04B 21/16

[52] U.S. Cl. ..... 15/209 B; 28/142; 66/202; 428/194; 428/253

[58] Field of Search ..... 15/208, 209 B; 51/400, 51/404; 66/9 A, 169, 170, 202; 156/149; 428/194, 253; 401/201

[56] References Cited

U.S. PATENT DOCUMENTS

| | | | |
|---|---|---|---|
| 1,773,734 | 8/1930 | Kean | 15/209 B |
| 1,794,854 | 3/1931 | Kean | 15/209 B |
| 2,273,033 | 2/1942 | Goodloe et al. | 15/209 B |
| 2,601,771 | 7/1952 | Cameron | 15/209 B X |
| 3,908,218 | 9/1975 | Oishi | 15/209 B |

FOREIGN PATENT DOCUMENTS

| | | | |
|---|---|---|---|
| 1,189,547 | 3/1959 | France | 15/209 B |
| 1,067,233 | 1/1954 | France | 15/209 B |
| 1,224,254 | 2/1960 | France | 15/209 B |
| 1,228,894 | 3/1960 | France | 15/222 |

*Primary Examiner*—Daniel Blum

*Attorney, Agent, or Firm*—Hopgood, Calimafde, Kalil, Blaustein & Lieberman

[57] ABSTRACT

A scouring-pad construction wherein an outer tubular envelope is inside-out loosely knitted around a loosely fabricated pliant stuffer material, given lengths of such materials being secured to establish end closure along generally transverse alignments. In a preferred form, the inner and outer materials are both knitted, and thermoplastic filament is an important component of both knits, the ends being heat-sealed for permanent closure by local fusion of such filaments.

15 Claims, 13 Drawing Figures

SCOURING PAD OR THE LIKE

This application is a continuation-in-part of my copending application, Ser. No. 553,509, filed Feb. 27, 1975.

The invention relates to an improved scouring-pad or the like construction.

An object is to provide an improved scouring-pad construction which does not require the separate handling step of inserting a stuffer material into a pliant outer envelope.

A further object is to provide such a construction whereby the material of a continuously knitted component can serve to effect bonded closure of ends of the construction.

A specific object is to meet the above objects with a construction whereby maximum use can be made of knitting techniques and whereby the completed end article may be derived by simple cut-off at predetermined longitudinal intervals of a continuously produced elongated pad assembly.

A general object is to meet the above objects with a superior structure at reduced cost, and requiring no manual assembly operations or secondary operations, once each article is served from a continuously produced length.

Other objects and various further features of novelty and invention will be pointed out or will occur to those skilled in the art from a reading of the following specification, in conjunction with the accompanying drawings. In said drawings, which show, for illustrative purposes only, a preferred method and embodiment:

Figure 1:
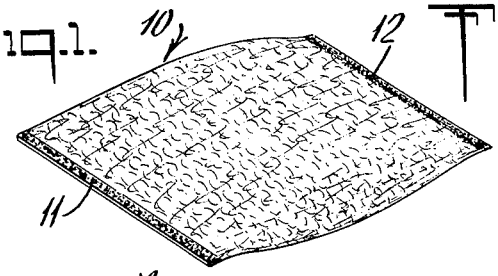
FIG. 1 is a perspective view of a pad of the invention.
Figure 3:
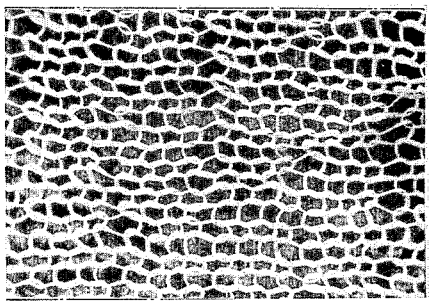
FIG. 3 is an enlarged photograph of a fragmentary area of the exposed face of the knitted length of FIG. 2.
Figure 2:
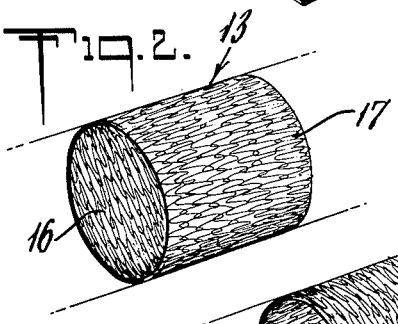
FIG. 2 is a perspective view of a short length of knitted material in inside-out orientation, and constituting the outer envelope of the pad of FIG. 1.
Figure 5:
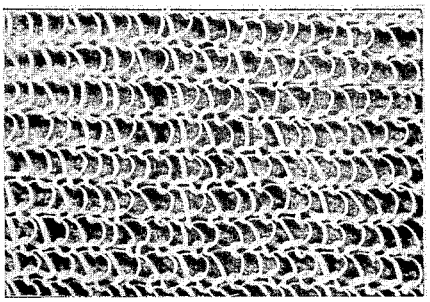
Figure 4:
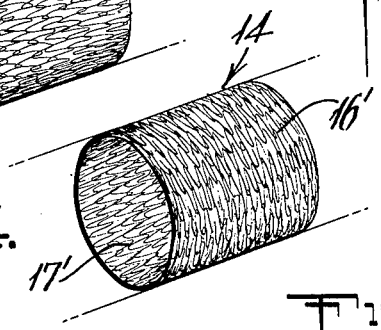
Figure 6:
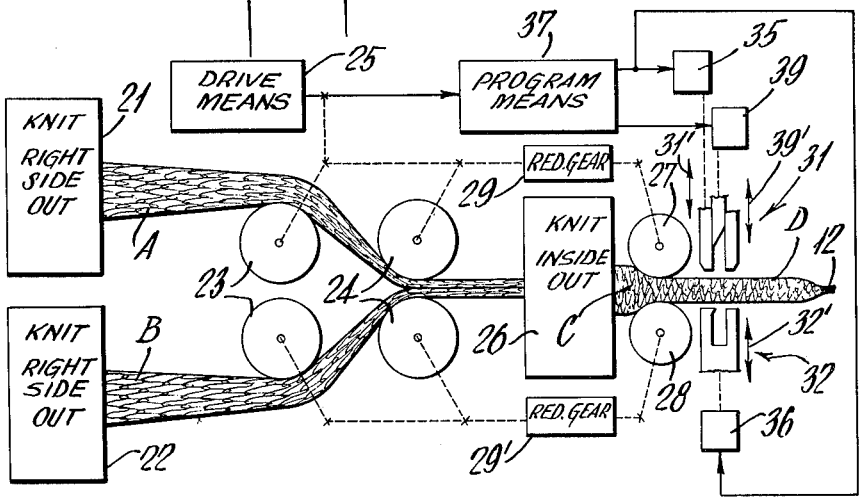
Figure 8:
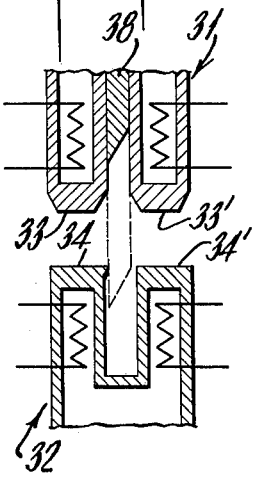
Figure 7:
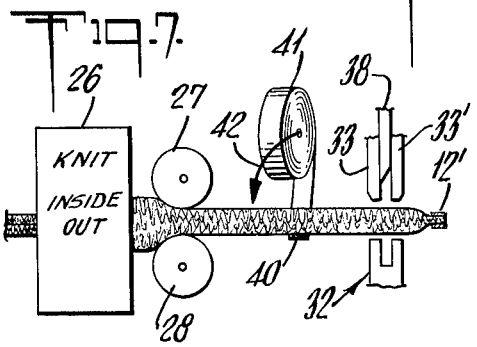
Figure 9:
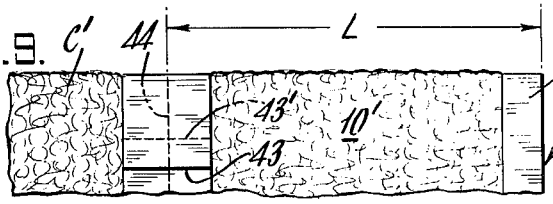
Figure 10:
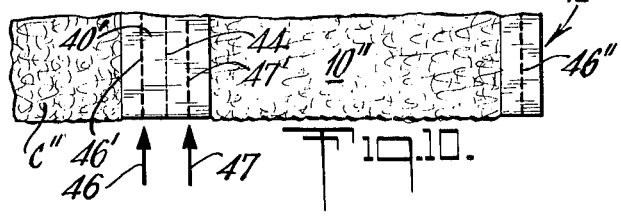
Figure 11:
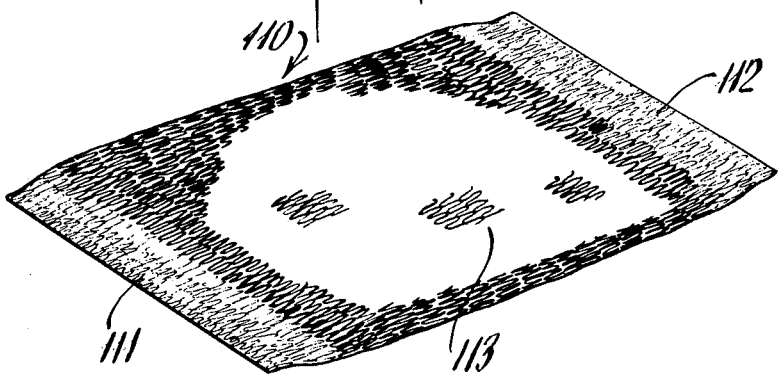
Figure 12:
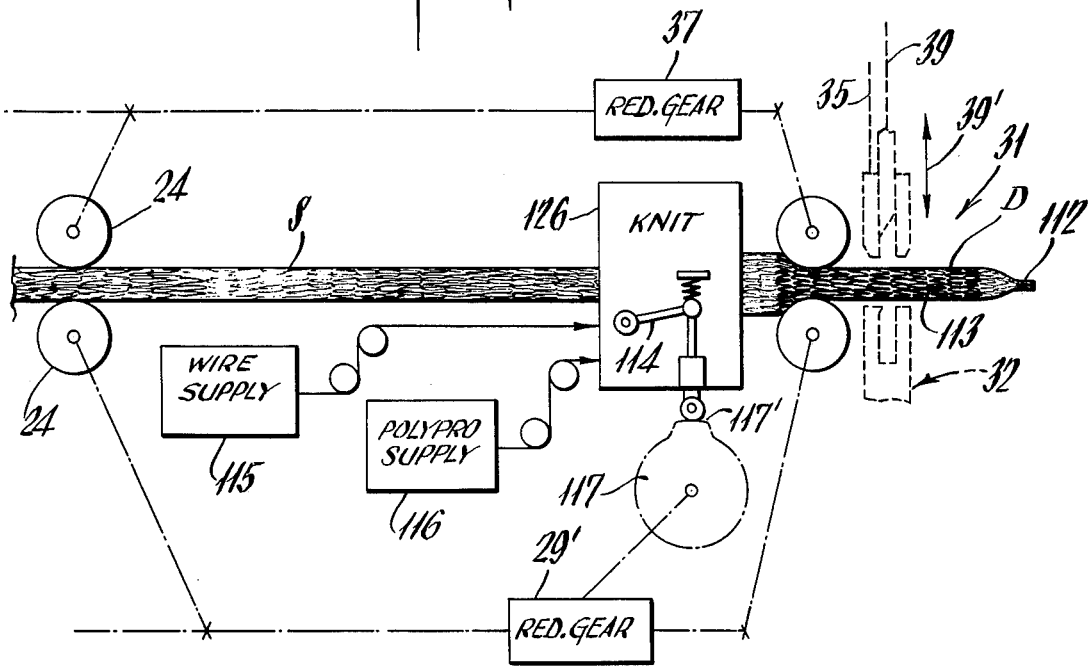
Figure 13:
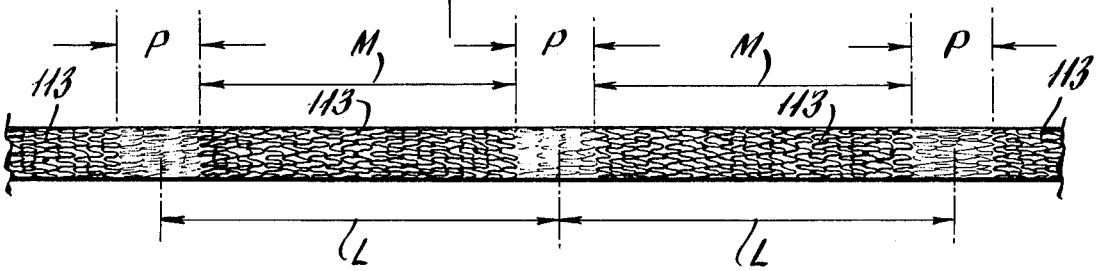

FIGS. 4 and 5 correspond to FIGS. 2 and 3 for the case of right-side out orientation of the knitted tube;

FIGS. 6 and 7 are simplified diagrams to illustrate fabrication steps, FIG. 7 being fragmentary to illustrate a modification;

FIG. 8 is a fragmentary enlarged sectional view of bonding and cut-off elements of FIG. 6;

FIGS. 9 and 10 are like fragmentary plan views of product of the method, at the stages of bonding and cut-off;

FIG. 11 is a view similar to FIG. 1 to show a modification;

FIG. 12 is a view similar to FIG. 6 to show apparatus for making the article of FIG. 11; and FIG. 13 is a simplified, fragmentary diagram to further show structure of the article of FIG. 11.

In FIG. 1, the invention is shown in application to a scouring or the like pad 10 comprising an outer envelope which is a predetermined length of loosely knitted plain-knit tubular material in inside-out orientation. The longitudinal ends 11–12 of this length are closely and permanently bonded along local generally transversely extending alignments, and a loosely fabricated stuffer material, which may be one or more predetermined lengths of loosely knitted tubular material, is retained within the outer envelope. The filamentary material used in the outer envelope may be of metal or of a thermoplastic such as polypropylene, or the outer envelope may be a combination of such filamentary materials; such use of filamentary materials may also characterize the inner length or lengths of stuffer material. Preferably, however, maximum use is made of the thermoplastic filament, and highly satisfactory products are made solely of filamentary polypropylene.

FIG. 2 shows an illustrative length 13 of inside-out oriented loosely knit material, preferred for the outer element of the pad of FIG. 1. This material is preferably knit in inside-out orientation and FIG. 2 will therefore be understood to represent part of the continuously produced output of a suitably set-up conventional plain-knit machine. In FIG. 2, the "right side" or "face" is identified 16, being inwardly facing, and the "reverse side" is identified 17 and is outwardly facing; this reverse side 17 appears in the photograph of FIG. 3. For further identification, the "grain" of the face 16 is shown to be characteristically longitudinal, i.e., as a circumferentially spaced array of longitudinally oriented rib features. In contrast, the outwardly exposed "reverse side" 17 is characterized by predominantly circumferentially extending rib features in nested and axially spaced array. Upon closure of the ends 11–12, therefore, it is the latter circumferentially extending rib features which are directly exposed for scouring action, in use of the completed product.

In similar fashion, I show in FIG. 4 an illustrative length of knitted material which may be as described for the length of FIG. 2, but which is constructed right-side out, so that the "face" 16′ (see FIG. 5) is externally exposed and the "reverse" side 17′ is internally facing. The length 14 is thus characterized by an externally exposed longitudinal grain, and by using the length 14 as stuffer material within the length 13, the longitudinal-grain faces 16-16′ of these lengths are placed in close, abutting adjacency, thus affording an important degree of mechanical interlock or keying, effective to restrain relative angular displacement of assembled lengths 13–14, in scouring-pad use. This mechanical interlock features is characteristic of the assembly, however many tubular lengths 14 are assembled in parallel side-by-side compressionally flattened adjacency within the outer envelope 13.

FIG. 6 schematically illustrates apparatus making maximum use of conventional plain-knit knitting machines for mass-production of pads as in FIG. 1, and for the illustrative case of using two parallel stuffer tubes of the FIG. 4 variety, within an outer envelope of the FIG. 2 variety. First and second parallel knitting machines 21–22 are each set-up to produce like continuous pliant plain-knit tubular outputs of stuffer material, respectively designated A-B and each is described at 14. First and second sets of feeder rolls 23–24 are synchronously and continuously driven by suitable means 25, to flatten both tubes and to bring them into side-by-side adjacency as they enter a third tubular knitting machine 26. This third machine 26 generates the outer envelope material 13 and is therefore set-up to produce an "inside-out" orientation of its tubular output C, it being understood that the output C is generated continuously around the flattend, continuously advancing stuffer material A-B. Output feed rolls 27–28 compress the outer tubular material upon the flattened stuffer plies A-B, for bonding and closure at pad-spaced intervals, as will be explained. Reduction-gear means at 29-29′ in the synchronous drive connections to rolls 27–28 will be understood to so control longitudinal stretch and therefore "neck-down" of plies A–B, in relation to an absence of stretch in envelope C, that the inner surface of envelope C agreeably accommodates the combined local peripheral extent of plies A–B as they become enshrouded by envelope C.

As previously indicated, at least some and preferably all of the filamentary construction of the knits is thermoplastic, thus enabling bonded closure of ends 11–12 by local application of heat at preselected longitudinal pad-defining intervals of the generally flattened product D of knitting-machine operation. The work-contacting elements of suitable apparatus to accomplish this function are shown generally in FIG. 6 and in greater detail in FIG. 8.

Briefly, for the form shown, upper and lower opposed electrically heated bonding-die elements 31–32 are disposed on opposite sides of the flattened knitted assembly D, it being understood that the outer projecting end of assembly D will always have been bonded along edge 12, by reason of the next-preceding cycle of operation. Each die element includes two longitudinal spaced feet 33-33' (for element 31) and 34-34' (for element 32), the corresponding feet 33–34 and 33'-34' to be brought into squeezing register with each other in their cooperative compressional action on assembly D, the action extending across the full transverse extent of assembly D and local to a first region to define the bonded trailing end 11 of one pad 10 and to slightly spaced but corresponding and parallel second such region to define the bonded leading end 12 of the next-succeeding such pad. Thus, die-head elements 31–32 will be understood to be guided for opposite reciprocated registering displacement, suggested by double arrows in FIG. 6, and to be suitably actuated by means 35–36 under the parallel-connected control of program means 37 having a synchronizing connection to the drive means 25. It will be understood, that depending upon the thickness and material of assembly D, the sqeezing time and pressure, and the heated extent of die-head elements 31–32 will be set to accomplish local fusion of thermoplastic filaments, to retain the closed end edges 11–12. Also, during such application of heat and pressure, a cut-off knife element 38, reciprocably guided by part of the upper die-head element, is actuated by means 39, from its retracted upper position to its extended cut-off position 38', to sever a pad 10 between the foot alignments 33–34 and 33'-34'. A double-headed arrow 39' suggests such knife reciprocation, also under coordinated control by program means 37.

FIG. 7 shows a modified heat-sealing technique for permanent end-closure of severed pad products, involving a peripheral wrap 40 of thermoplastic ribbon or tape, such as commercially available vinyl tape (for example, of 1-inch width), at pad-length intervals. The tape wrap 40 is supplied from a reel 41 which will be understood to be suitably supported at a location offset from the continuously advancing knitted-tube assembly, and to be periodically subjected to an orbital path of movement about the knitted-tube assembly, as suggested by the arcuate heavy arrow 42. Tape wrap 40 may be developed at region C, i.e., prior to the flattening step at 27–28, but I prefer to develop wrap 40 after such flattening and prior to heat-sealing and cut-off by means 31–32. It will be understood that the tape-wrap and cut-off functions are suitably synchronized with continuous advance of the knitted-tube assembly, as by slide-mounting both reel 41 (and its gyrating support mechanism, suggested at 42) and the heat-seal and cut-off means 31–32 at pad-length spacing, and longitudinally reciprocating the slide mounting such that a forward stroke thereof matches the feed speed of the knitted-tube assembly, thereby allowing tape-wrap, heat-sealing and cut-off to proceed in accurate register for each severed product.

FIG. 9 shows the final steps of FIG. 7 in terms of the product alone. The advancing knitted-tube assembly (designated C') is shown with an applied tape wrap 40 having overlapped ends 43-43' and so positioned with respect to the previously cut-off end 12' that the design product-length interval L establishes a next cut-off alignment 44 at the longitudinal center of wrap 40. By the time wrap 40 reaches the cut-off station, the heat-sealing feet 33–34 and 33' 34' will register with wrap 40 and will also place knife 38 in the central cut-off alignment 44. The final step thus induces fusion of tape material to itself and to the adjacent polypropylene filaments of compressed knit material, while cutting the tape wrap 40 in half to form a banded end margin at 45.

FIG. 10 illustrates further modification as to the final steps of bonding and cut-off, wherein stitching as with polypropylene filament is relied upon to secure the pad ends 11–12, using two spaced stitching heads (suggested by heavy arrows 46–47) at opposite longitudinal offsets from the cut-off alignment 44. The stitching heads will be understood to be supported for transverse reciprocation, across the knitted-tube assembly, and to be slide-mounted for intermittent longitudinal coordination with the continuous advance of the knitted-tube assembly, as in the case of the tape-applying mechanism of FIG. 7. Resulting stitch seams are indicated at 46'-47' and may be applied directly to the knitted-tube assembly, after flattening compression by rolls 27-27'; however, I indicate a preference to apply the stitching over a tape band 40' which may or may not be of thermoplastic material. For the case of a 1-inch wide tape wrap 40', the stitched seams may be at ½ to ¾-inch spacing; and if no tape wrap is employed, the stitching alignments 46'-47' are preferably in the order of ¾-inch apart.

It will be understood that the mechanism for applying tape 40' may be as described for tape 40 in FIG. 9, except that if slide-mounted with stitching means 46–47 and cut-off means 31–32, the tape-applying means should be longitudinally offset at least to the extent of an integer multiple of the pad length L, from stitching means 46–47. Of course, if band 40' is thermoplastic, as in the case of band 40 in FIG. 9, the final heat-sealing step will have been additionally secured and reinforced by the stitching, as shown at 46'-47' for the unsevered band 40' of FIG. 10, and as shown at 46'' for the severed free end 12''.

FIG. 11 will be recognized for its similarity to FIG. 1, but it illustrates a modified scouring pad wherein the knitted outer tube comprises a relatively extensive central region 113 characterized by loosely knitted metal filament, and by relatively short end regions of loosely knitted thermoplastic filament, the latter regions being used for end closure, sealing, and cut-off, in the manner already described. Preferably, the knitting action is inside-out, so as to present maximum scouring capability in the region 113.

FIG. 12 shows apparatus for making the article 110 and will be recognized for its similarity to FIG. 6; for this reason, many of the same reference numbers are used for corresponding parts. In contrast, however, the tube-knitting machine 126, which is continuously operative to knit the outer tube about continuously fed stuffer material S, includes means such as that schematically indicated by a shiftable crank arm 114 whereby instant change-over can be accomplished, as between two different filamentary materials to be knitted. In the case shown, the two materials are metal filament from a "wire" supply 115 and thermoplastic filament from a "polypropylene" supply 116. The instantaneous position of crank 114, and therefore the instantaneous use of metal or plastic filament, is governed by follower action from a rotary program cam 117 shown with drive pick off from reduction-gear means 29'. It will be understood that the full time cycle of cam 117 is selected for the period to achieve pad-unit advance L of compressed pad material at D, and that the relatively short rise 117' of cam 117 is of duration and phase to determine knitted use of the thermoplastic material from supply 116. Securing (bonding) and cut-off operations are performed as previously described, in synchronism with the same period of pad-unit advance L, using means as at 31–32 and already described, it being noted that such operations are of course properly phased to assure use of the knitted-plastic end regions for bonding and cut-off.

For a better identification of knitted regions as produced continuously by the machine 126, reference is made to FIG. 13 wherein light and dark interlaced regions will be understood to identify the interlaced relation of relatively short thermoplastic knit and relatively long metal-filament knit, respectively. The knitted length P is shown for the thermoplastic-knit regions, and the knitted length M is shown for the metal-filament knit regions; and both these regions are shown in relation to the pad unit-length interval L. For the illustrative case of a 5-inch unit length L, the thermoplastic regions P may be of about one-inch length, leaving a relatively extensive 4-inch region M of metal-knit scouring capability. The stuffer S may be combined knitted tubes or combined flat layers, preferably of thermoplastic material and advantageously loose-knitted. Thus, thermoplastic bonding of outer tube to stuffer material is achieved as already described.

The described structure and methods of making the same will be seen to have met all stated objects. A uniform and superior product 10 (10', in FIG. 9; 10'', in FIG. 10; and 110 in FIG. 11) is mass-produced without manual intervention, using conventional plain-knit machines and techniques. In the use of polypropylene filamentary material throughout the knitting process, I have found satisfactory and therefore prefer a ribbon-like filament which is commercially available from ACS Industries, Inc., Woonsocket, Rhode Island; such polypropylene monofilament has a generally elliptical section characterized by a minor/major extent of 0.009-inch/0.030-inch. Where metal filament is used, I have found an analogous elliptical or ribbon-like section to be satisfactory when characterized by similar minor/major dimensions. The tubular components are loosely woven, and it is found adequate to rely upon random orientation of the elliptical section in the course of knitting, to obtain a satisfactory end product, as of the approximate overall dimensions 3 ½ inches wide by 5 inches long.

While the invention has been described in detail for preferred forms and methods, it will be understood that modification may be made without departing from the spirit and scope of the invention.

What is claimed is:

1. A scouring pad comprising an axially extending length of loosely knitted pliant outer tubing, an axially extending loosely fabricated inner stuffing material within said outer tubing and extending to substantially the axial ends of said outer tubing, the said outer tubing being a single continuously knit length comprising a relatively long central region of knitted metal filament and contiguous relatively short non-metallic end regions of knitted thermoplastic filament, said outer tubing being secured at its end regions on compressed generally transverse alignments through the knitted thermoplastic regions of said tubing, and through the stuffing material thereby retaining closure of both ends of the outer tubing, without exposure of outer-tubing metal at the secured ends.

2. A scouring pad comprising an axially extending length of loosely knitted pliant outer tubular scouring material, said length being in inside-out orientation, an axially extending length of loosely knitted pliant inner tubular stuffing material within said outer tubular material in face-out orientation and extending to substantially the axial ends of said outer tubular material, said outer material being secured at its ends on compressed generally transverse alignments, thereby retaining closure of both ends of the outer tubular length, in substantial grain-matching relation with the adjacent surface of said inner tubular material.

3. A scouring pad according to claim 2, in which the length of outer tubular material comprises a relatively long central region of knitted metal in continuously knitted contiguous relation to and between the secured end regions, and in which said length further comprises relatively short end regions of knitted thermoplastic filament at the secured alignments.

4. A scouring pad according to claim 3, in which the thermoplastic end regions are locally fused at the secured alignments for bonded retention of the closed ends.

5. A scouring pad according to claim 4, in which the stuffer material is of thermoplastic filament, the fusing at the secured ends being as between thermoplastic filaments of both the outer tubular length and the stuffer material.

6. A scouring pad according to claim 2, in which each secured end is secured by a stitched transverse seam of filamentary material.

7. A scouring pad according to claim 6, in which a peripheral ribbon around each longitudinal end of the pad is stitched to the knitted tubular material by said seams.

8. A scouring pad according to claim 2, in which a peripheral ribbon of thermoplastic material is adjacent the outer face of the outer tube and local to each longitudinal end of the pad, said thermoplastic material being fused to adjacent knitted material on said alignments.

9. A scouring pad according to claim 8, in which each of the fused end regions is further secured by at least one stitched seam of filamentary material, the filamentary material of the seams extending entirely through and retaining squeezed compression of opposed tape regions upon knitted material.

10. A scouring pad according to claim 1, in which the inner stuffing material is a length of tubular knitted filamentary thermoplastic material.

11. A scouring pad according to claim 10, in which the knit orientation of the outer tubular length is inside-out and that of the inner tubular length is right-side out.

12. A scouring pad according to claim 10, in which the inner tubular length is one of a plurality of such inner tubular lengths all of which are within said outer tubular length.

13. A scouring pad according to claim 10, in which thermoplastic components of both lengths are locally fused to each other at the secured alignments.

14. A scouring pad according to claim 2, in which the material of the outer tubular length includes a thermoplastic filamentary component, locally fused at the secured alignments for bonded retention of the closed ends.

15. A scouring pad according to claim 2, in which the material of the outer tubular length includes a filamentary metal element.

* * * * *